US008746224B2

(12) United States Patent
Khoshnood et al.

(10) Patent No.: US 8,746,224 B2
(45) Date of Patent: Jun. 10, 2014

(54) ROTATING ARCHERY ARROW REST

(76) Inventors: Bahram Khoshnood, Cumming, GA (US); David Potts, New Philadelphia, PA (US)

( * ) Notice: Subject to any disclaimer, the term of this patent is extended or adjusted under 35 U.S.C. 154(b) by 190 days.

(21) Appl. No.: 13/312,895

(22) Filed: Dec. 6, 2011

(65) Prior Publication Data

US 2012/0152222 A1 Jun. 21, 2012

Related U.S. Application Data

(60) Provisional application No. 61/423,201, filed on Dec. 15, 2010.

(51) Int. Cl.
*F41B 5/22* (2006.01)

(52) U.S. Cl.
USPC ..... 124/44.5

(58) Field of Classification Search
USPC ..... 124/44.5
See application file for complete search history.

(56) References Cited

U.S. PATENT DOCUMENTS

| | | | | |
|---|---|---|---|---|
| 2,691,974 | A * | 10/1954 | Nelson | 124/44.5 |
| 7,856,968 | B2 * | 12/2010 | Mizek et al. | 124/44.5 |
| 2011/0168147 | A1 * | 7/2011 | Schaffer | 124/44.5 |
| 2012/0285432 | A1 * | 11/2012 | Adams | 124/44.5 |

* cited by examiner

*Primary Examiner* — John Ricci
(74) *Attorney, Agent, or Firm* — Brient Globerman, LLC

(57) ABSTRACT

An arrow rest for a bow, according to various embodiments, comprises (1) an arrow rest mount, (2) an arrow rest base that is disposed adjacent the arrow rest mount, (3) a first arrow support that is disposed adjacent a top surface of said arrow rest base and that is defined by a first base potion with a first ramped face and a first angled top portion, and (4) a second arrow support that is disposed adjacent a top surface of said arrow rest base and that is defined by a second base potion with a second ramped face and a second angled top portion. The first and second arrow supports are adapted to rotate to exert opposing lateral forces on an arrow at substantially the same time that facilitate the movement of the arrow up the first and second ramped faces and into a ready to fire position.

18 Claims, 12 Drawing Sheets

ROTATING ARCHERY ARROW REST

CROSS REFERENCE TO RELATED APPLICATIONS

This application claims the benefit of U.S. Provisional Application No. 61/423,201, entitled "Archery arrow rest that lifts the arrow into the shooting plane manually or by drawing the bow using a spinning or rotating motion. When the arrow is released the arrow rest spins out of the way eliminating contact with the arrow or its components," filed Dec. 15, 2010, which is hereby incorporated herein by reference.

BACKGROUND

Arrow rests are used in combination with a bow to support an arrow during draw and release of the bow's bowstring. Because of an arrow's fletching, arrow rests can interfere with the flight of an arrow as the arrow passes the arrow rest by coming in contact with the fletching of the arrow. Additionally, many arrow rests limit the orientation in which the bow can be held when firing an arrow. For example, holding a bow in an orientation other than a vertical orientation can result in the arrow falling off of the arrow rest after the bowstring is drawn but prior to firing. Finally, many arrow rests fail to maintain an arrow within the arrow rest when an arrow is in a resting position prior to the bowstring being drawn. Accordingly, there is a need for improved arrow rests that address one or more of the problems described above.

SUMMARY OF THE INVENTION

An arrow rest for a bow comprising: (1) an arrow rest mount; (2) an arrow rest base disposed adjacent the arrow rest mount; and (3) a first arrow support disposed adjacent a top surface of the arrow rest base. In particular embodiments, the first arrow support defines: (1) a first base portion extending upwardly from a base of the first arrow support, wherein the first base portion defines a first ramped face that extends upwardly and rearwardly along a leading edge of the first base portion; (2) a first angled top portion extending upwardly and forward from an upper end of the first base portion; and (3) a second arrow support disposed adjacent a top surface of the arrow rest base. In certain embodiments, the second arrow support defines: (1) a second base portion extending upwardly from a base of the second arrow support, wherein the second base portion defines a second ramped face that extends upwardly and rearwardly along the leading edge of the second base portion; and (2) a second angled top portion extending upwardly and forwardly from an upper end of the second base portion. In particular embodiments: (A) the arrow rest base, the first arrow support, and the second arrow support are positioned about an axis of rotation (e.g., on opposite sides of the axis of rotation and at substantially equal distances from the axis of rotation); (B) the first arrow support and the second arrow support are adapted to rotate about the axis of rotation to exert opposing lateral forces on an arrow at substantially the same time; and (C) the opposing lateral forces facilitate the movement of the arrow up the first ramped face and the second ramped face.

An arrow rest for a bow, according to various embodiments, comprises: (1) a first ramp; (2) a second ramp that is spaced apart from the first ramp; (3) a linkage that is adapted to link the arrow rest to a portion of the bow so that, when a user draws the bow, the linkage facilitates a rotating lateral movement of the first ramp toward an arrow that is loaded in the bow. In particular embodiments, the first and second ramps are adapted to cooperate to lift the arrow into a ready-to-fire position by exerting opposing forces on a shaft of the arrow as the first ramp moves laterally toward and engages the arrow.

An arrow rest for a bow according to certain embodiments comprises: (1) a first arrow lifting means, and (2) a second arrow lifting means, wherein: (A) the first arrow lifting means and the second arrow lifting means are adapted to rotate to exert opposing lateral forces on an arrow; and (B) the opposing lateral forces facilitate the movement of the arrow from a first, resting position to a second, ready-to-fire position.

BRIEF DESCRIPTION OF THE DRAWINGS

Having described various embodiments in general terms, reference will now be made to the accompanying drawings, which are not necessarily drawn to scale, and wherein.

DETAILED DESCRIPTION OF VARIOUS EMBODIMENTS

Various embodiments will now be described more fully hereinafter with reference to the accompanying drawings, in which various relevant embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

First Rotating Arrow Rest Embodiment

Figure 4:
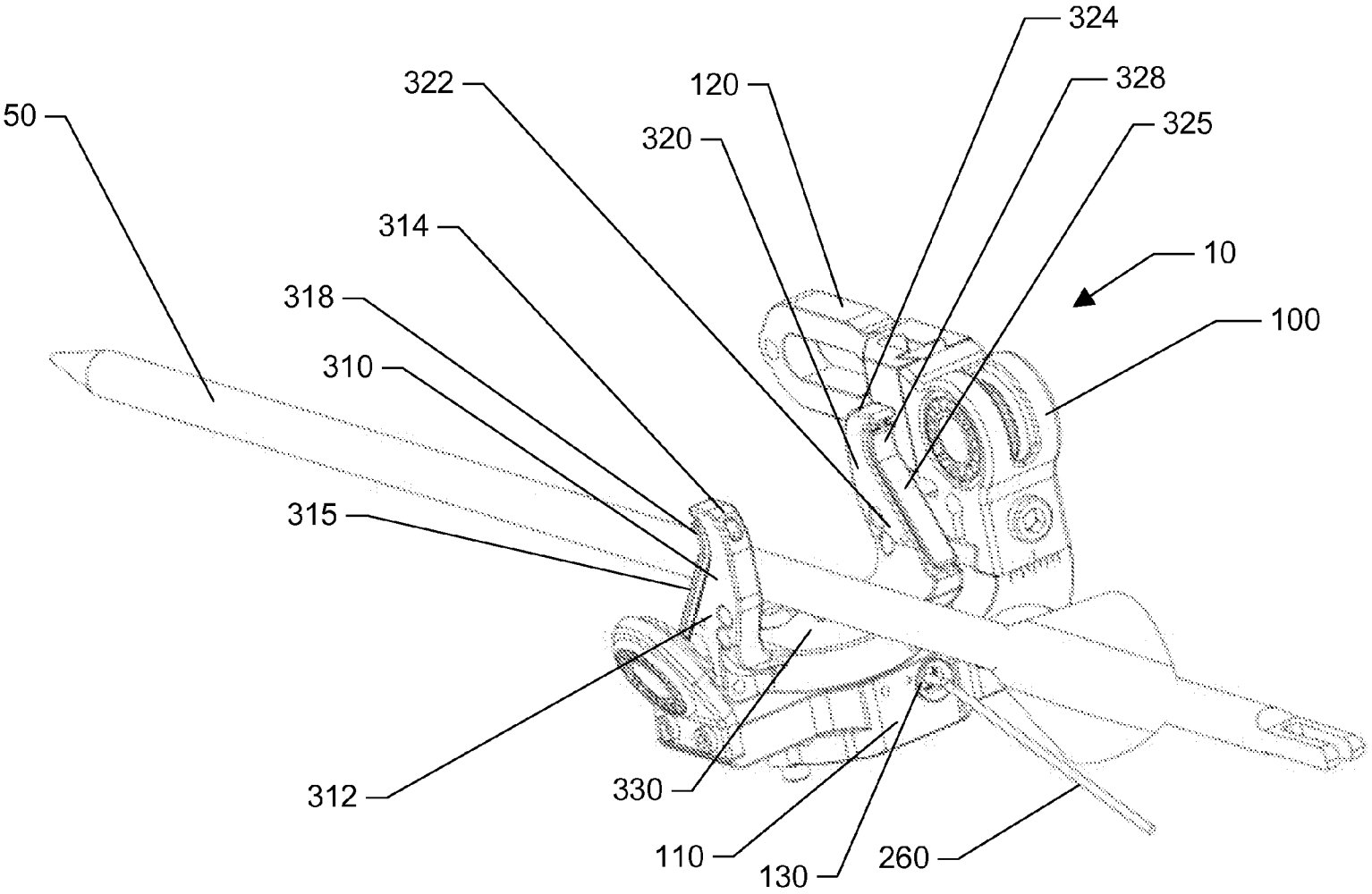
FIG. 4 is a perspective view of the arrow rest of FIG. 1 in the first, resting position.

An arrow rest 10 according to a particular embodiment is shown in FIGS. 1-12. As shown in FIG. 4, in this embodiment, the arrow rest 10 comprises: (1) an arrow rest base 330; (2) a first arrow support 310; (3) a second arrow support 320; and (4) an arrow rest mount 100. These various components are discussed in greater detail below.

Arrow Rest Base

In the embodiment shown in FIG. 4, the arrow rest base 330 is disposed adjacent (e.g., to) the base of the arrow rest mount 100 in any suitable manner (e.g., with a suitable fastener or screw). In various embodiments, the arrow rest base 330 is substantially round (e.g., round). In other embodiments, the arrow rest base 330 may be any suitable shape (e.g., square, rectangular, or any other suitable shape). In various embodiments, the top surface of the arrow rest base 330 is substantially flat (e.g., flat). Other embodiments of the arrow rest base 330 may include any other suitable surface geometry (e.g., a domed surface). The arrow rest base 330 may be made of any suitable material (e.g., a suitable metal such as aluminum, or plastic).

First Arrow Support

In the embodiment shown in FIG. 4, the first arrow support 310 comprises: (1) a first base portion 312 that defines a first ramped edge 315; and (2) a first angled top portion 314 that defines a first arrow holding recess 318. The first arrow support 310 may be substantially planar (e.g., planar), or in any other suitable configuration.

In this embodiment, the first base portion 312 extends upwardly and rearwardly from the base 312 of the first arrow support 310. As shown in FIG. 4, the sides of the first base portion 312 are substantially flat. In the embodiment shown in FIG. 4, the first arrow support 310 defines a first angled top portion 314. In this embodiment, the first angled top portion 314 extends upwardly and forwardly at an angle from an upper portion of the first base portion 312. In particular embodiments, the angle between the base portion 312 and the angled top portion 314 may be between about zero and about ninety degrees.

In the embodiment shown in FIG. 4, the first arrow support 310 defines a first ramped face 315. In this embodiment, the first ramped face 315 extends from the base of the first arrow support 310 upwardly and rearwardly along the leading face of the first base portion 312. In the embodiment shown, the first ramped face 315 extends to a lower portion of the first angled top portion 314. As shown in FIG. 4, the first ramped face 315 is substantially straight (e.g., straight) and substantially flat. In particular embodiments, the first ramped face 315 is sufficiently smooth to allow the shaft of an arrow 50 to slide up the first ramped face 315.

In particular embodiments, as shown in FIG. 4, the upper portion of the first ramped face 315 defines a first arrow holding recess 318. In the embodiment in FIG. 4, the first arrow holding recess 318 defines a substantially curved (e.g., curved) recess in the first ramped face 315. In this embodiment, the radius of the curve of the first arrow holding recess 318 substantially corresponds to (e.g., corresponds to) the radius of the shaft of a standard arrow.

As shown in FIG. 4, the first arrow support 310 is disposed adjacent (e.g., to) an outer edge of the top surface of the arrow rest base 330. The first arrow support 310 may be attached to the arrow rest base 330 in any suitable manner (e.g., using suitable fasteners or welding techniques). The first arrow support 310 may be made of any suitable (preferably sturdy) material (e.g., a suitable metal such as aluminum or steel, or plastic).

In the embodiment shown in FIG. 4, the plane of the first arrow support 310 is substantially perpendicular (e.g., perpendicular) to the plane of the top surface of the arrow rest base 330. Additionally, the plane of the first arrow support 310 is substantially perpendicular (e.g., perpendicular) to the ground when a user is using a bow with the arrow rest 10 and holding the bow in a vertical orientation.

Second Arrow Support

In the embodiment shown in FIG. 4, the second arrow support 320 is substantially structurally identical (e.g., identical) to the first arrow support 310. In this embodiment, the second arrow support 320 comprises: (1) a second base portion 322 that defines a second ramped edge 325; and (2) a second angled top portion 324 that defines a second arrow holding recess 328. As may be understood from FIG. 4, in various embodiments, each part of the second arrow support 320 is substantially identical (e.g., identical) to the corresponding part of the first arrow support 310.

As may be understood form FIG. 4, the plane in which the second arrow support 320 is positioned may be substantially parallel (e.g., parallel) to the plane in which the first arrow support 310 is positioned. As shown in FIG. 4, the second arrow support 320 is disposed adjacent (e.g., to) an outer edge of the top surface of the arrow rest base 330 a distance from the first arrow support 310. In certain embodiments, the first arrow support 310 and second arrow support 320 are positioned on opposite sides of an axis of rotation of the arrow rest base 330, and are each spaced about the same distance (e.g., the same distance) from this axis of rotation. The second arrow support 320 may be attached to the arrow rest base 330 in any suitable manner (e.g., using suitable fasteners or welding techniques). As may be understood from FIG. 4, the second arrow support 320 is positioned facing a direction that is substantially opposite (e.g., opposite) the direction that the first arrow support 310 is facing.

As shown in FIG. 4, the second arrow support 320 is substantially perpendicular (e.g., perpendicular) to the plane of the top surface of the arrow rest base 330. Additionally, the plane of the second arrow support 320 is substantially perpendicular (e.g., perpendicular) to the ground when a user is using a bow with the arrow rest 10 and holding the bow in a vertical orientation.

Axis of Rotation

In various embodiments, the arrow rest base 330, the first arrow support 310, and the second arrow support 320 are adapted to rotate about an axis of rotation. In the embodiment shown in FIG. 4, the axis of rotation extends through a point that is substantially centered (e.g., centered) on the arrow rest base 330.

Figure 6:
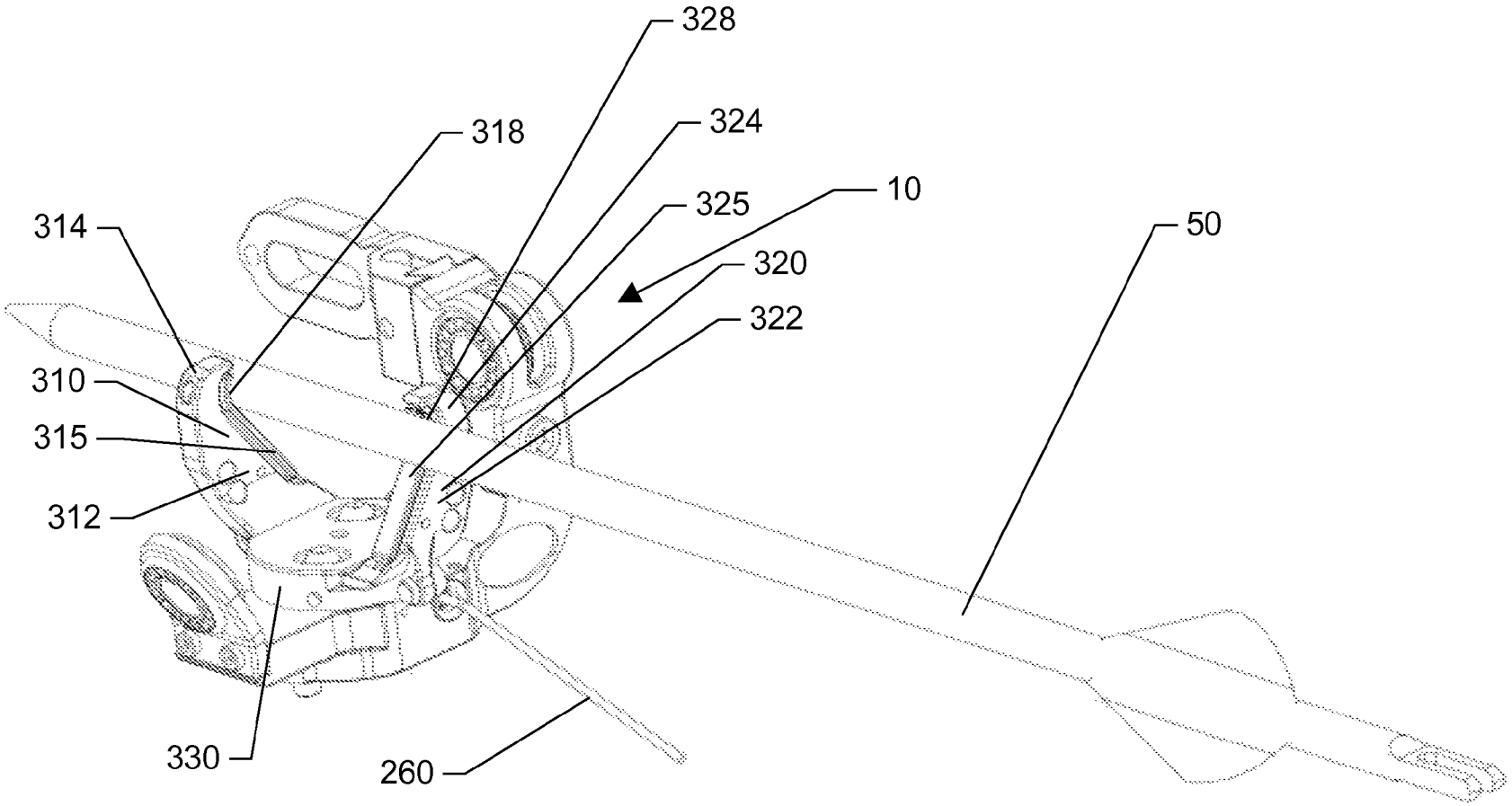
FIG. 6 is a perspective view of the arrow rest of FIG. 1 in the second, ready-to-fire position.

FIG. 4 shows the arrow rest base 330, the first arrow support 310, and the second arrow support 320 in a first, resting position. FIG. 6 shows the arrow rest base 330, the first arrow support 310, and the second arrow support 320 in a second, ready-to-fire position. In the second, ready-to-fire position, the arrow rest base 330, the first arrow support 310, and the second arrow support 320 are in a position about the axis of rotation at least about ninety degrees from the position that the arrow rest base 330, the first arrow support 310, and the second arrow support 320 are in about the axis of rotation in the first, resting position. The arrow rest base 330 may include a stopping mechanism that prevents the arrow rest base 330, the first arrow support 310, and the second arrow support 320 from rotating past the second, ready-to-fire position. This stopping mechanism that prevents the arrow rest base 330, the first arrow support 310, and the second arrow support 320 from rotating past the second, ready-to-fire position may include any suitable mechanism (e.g., a pin).

In the embodiment shown in FIG. 4, the arrow rest base 330 includes a biasing mechanism for biasing the arrow rest 10 towards a particular home position. The particular home position may be, for example, the first, resting position as shown in FIG. 4. In particular embodiments, the biasing mechanism may include a torsion spring. In various embodiments, the torsion spring may be disposed within the arrow rest base 330. In other embodiments, the biasing mechanism may include any other suitable mechanism for biasing the arrow rest 10 towards the particular home position (e.g., a linear spring). In the embodiment shown in FIG. 4, the arrow rest base 330 includes a stopping mechanism that is adapted to prevent the biasing mechanism from biasing the arrow rest 10 past the first, resting position. The stopping mechanism may include any suitable mechanism (e.g., a pin) for preventing the biasing mechanism from biasing the arrow rest past the first, resting position.

Arrow Rest Mount

As shown in FIG. 4, the arrow rest mount 100 includes a base 110 and an arm 120. As may be understood from FIG. 4, the rear portion of the base 110 of the arrow rest mount 100 includes an opening 130. In this embodiment, the opening 130 is sufficiently large to allow a cord 260 to pass through the opening 130. As shown in FIG. 4, the arm 120 of the arrow rest mount 100 is disposed adjacent (e.g., to) an end portion of the base 110 of the arrow rest mount 100. The arm 120 of the arrow rest mount 10 extends forward and substantially perpendicularly (e.g., perpendicularly) from the base 110 of the arrow rest mount 100.

Figure 1:
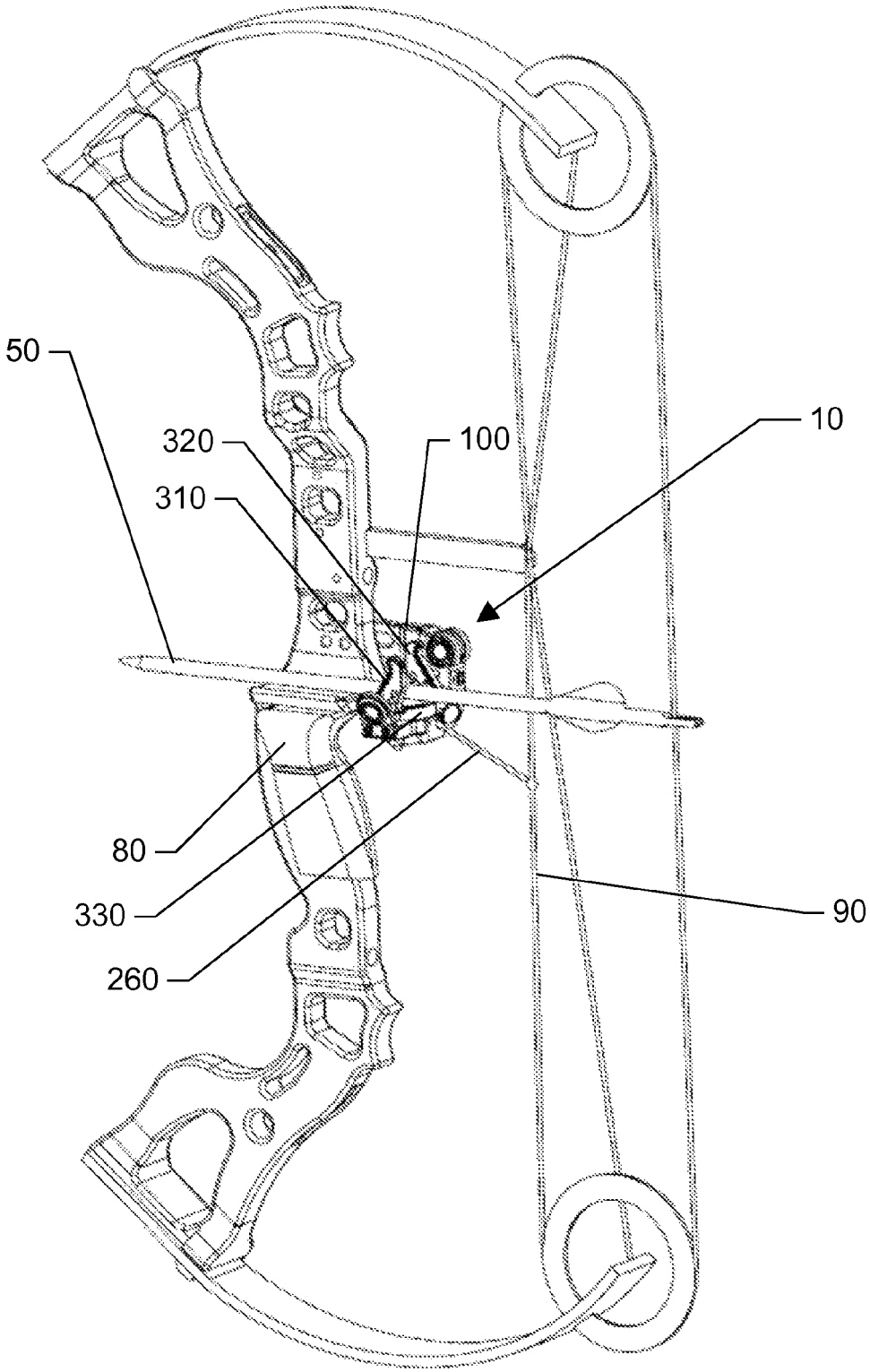
FIG. 1 is a perspective view of a first embodiment of an arrow rest on a bow in a first, resting position.

As shown in FIG. 1, the arm 120 of the arrow rest mount 100 may be attached to a bow in any suitable manner (e.g., using suitable fasteners such as screws). As may be understood from FIG. 1, the arrow rest mount 100 may be adapted to maintain the arrow rest 10 in a particular orientation relative to the bow.

Cord

In the embodiment shown in FIG. 4, the arrow rest 10 includes a cord 260 that may be made of any appropriate, preferably strong and flexible, material (e.g., an appropriate synthetic material such as Kevlar). In various embodiments, the cord 260 may be any suitable flexible and/or rigid element (e.g., a string, line, cable, or rod). In particular embodiments, the cord 260 may include string or rope made from several twisted or woven strands. In other embodiments, the cord 260 may include string or rope made from a single strand. In other embodiments, the cord 260 may be a chain. In the embodiment shown in FIG. 4, the cord 260 runs through the opening in the arrow rest mount 100.

In the embodiment shown in FIG. 4, the cord 260 may be adapted to rotate the arrow rest base 330, the first arrow support 310, and the second arrow support 320 away from the first, resting position into the second, ready-to-fire position in response to the cord 260 being pulled. In this embodiment, a first end of the cord 260 is attached adjacent (e.g., to) the arrow rest base 330 a distance from the axis of rotation of the arrow rest base 330. As may be understood from FIG. 1, the second end of the cord 260 may be substantially coupled with (e.g., coupled with) the bowstring 90 of a bow 80. In this embodiment, the second end of the cord 260 is substantially coupled (e.g., coupled) with the bowstring at a point on the bowstring that is below the arrow rest 10 when the bow is in a substantially vertical (e.g., vertical) orientation.

Figure 2:
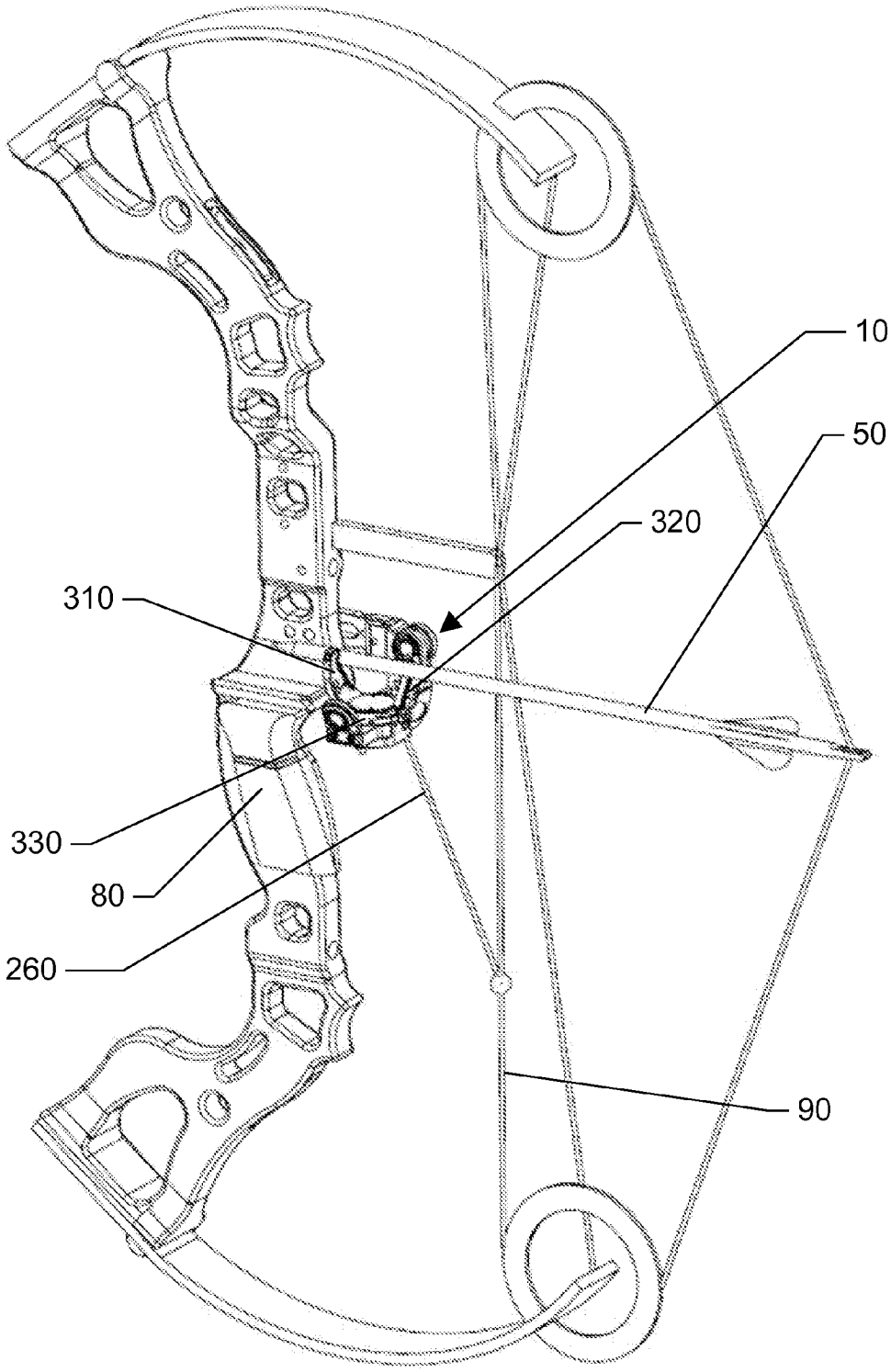
FIG. 2 is a perspective view of the arrow rest and bow of FIG. 1 in which the arrow rest is in a second, ready-to-fire position.
Figure 3:
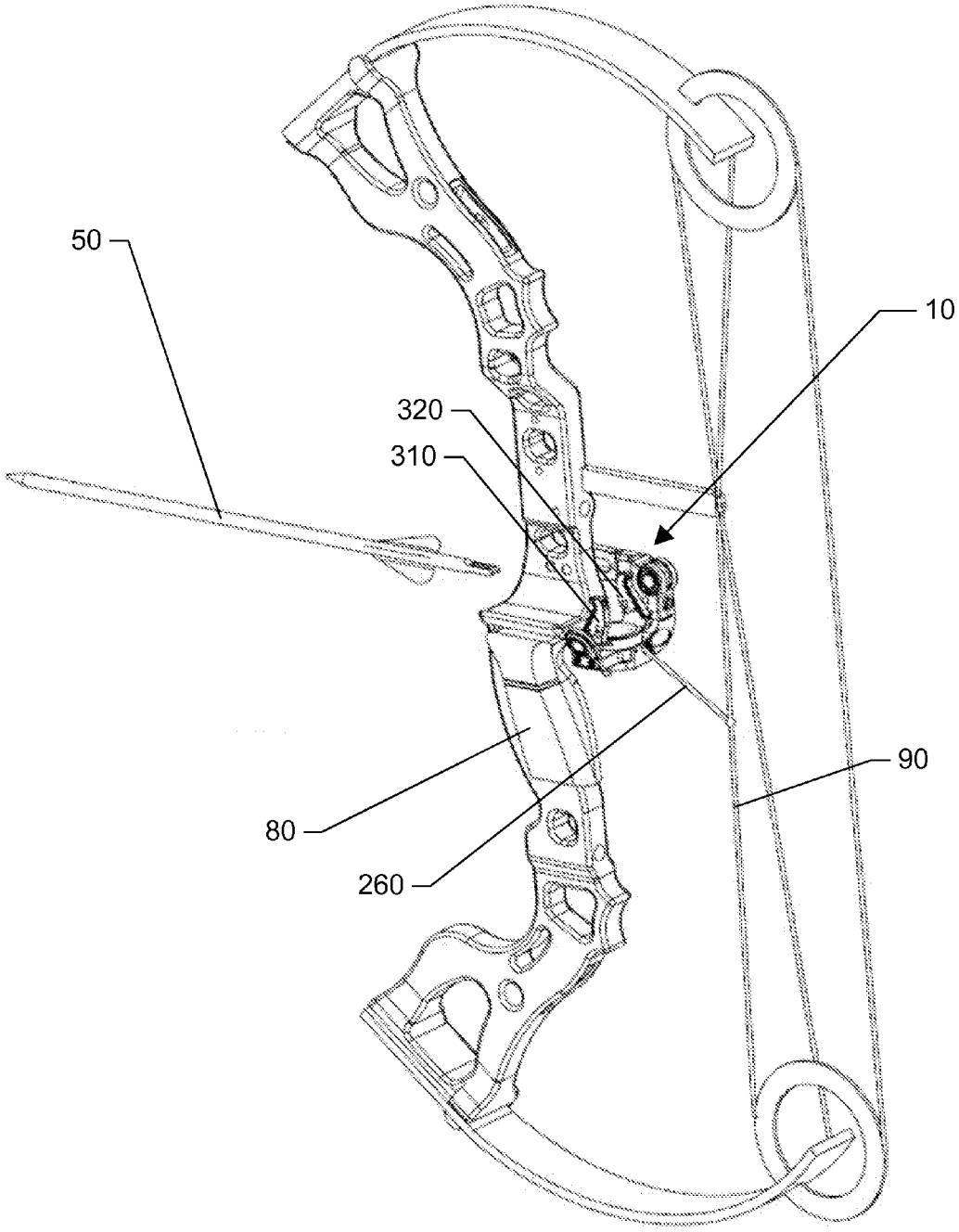
FIG. 3 is a perspective view of the arrow rest and bow of FIG. 1 immediately following the firing of the arrow.

As may be understood from FIGS. 1-2, as an archer draws a bow's bowstring to fire an arrow 50, the bowstring pulls on the cord 260, causing the arrow rest base 330, the first arrow support 310, and the second arrow support 320 to rotate away from the first, resting position. In this embodiment, the cord 260 may be adapted to rotate the arrow rest base 330, the first arrow support 310, and the second arrow support 320 into the second, ready-to-fire position as the bowstring is drawn from a non-drawn position to a fully drawn position (e.g., the position shown in FIG. 2).

Exemplary Steps for Firing an Arrow Using the Rotating Arrow Rest

Figure 5:
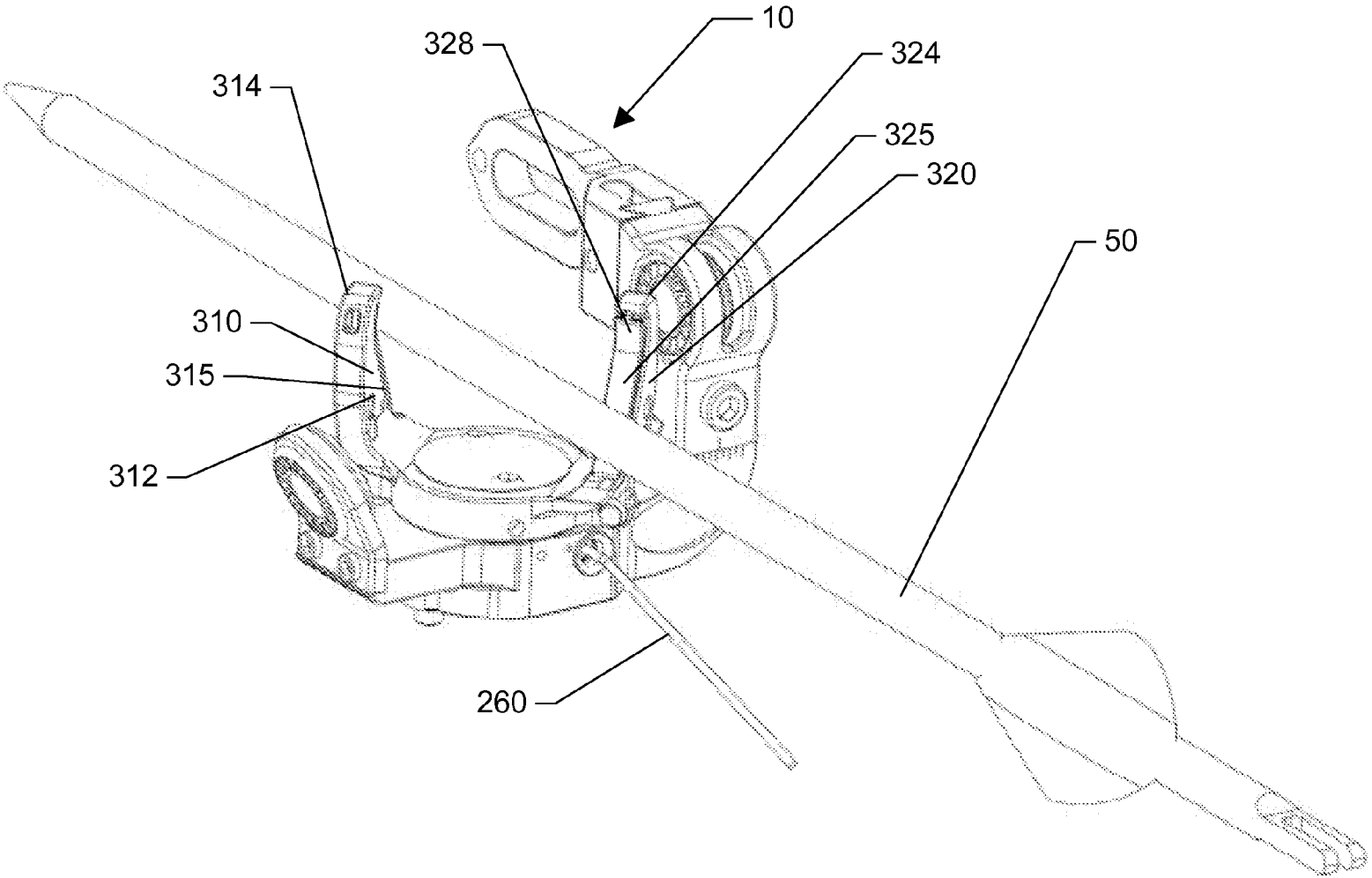
FIG. 5 is a perspective view of the arrow rest of FIG. 1 between the first, resting position and the second, ready-to-fire position.

FIGS. 4-6 show a perspective view of the embodiment of the arrow rest 10 of FIG. 1 as an arrow 50 is moved from a first, resting position to a second, ready-to-fire position. As may be understood from FIG. 4, in the first, resting position, an arrow 50 has been placed between the first arrow rest support 310 and the second arrow rest support 320. In the embodiment shown in FIG. 4, the arrow 50 is resting on the arrow rest base 330.

After placing the arrow 50 between the first arrow rest support 310 and the second arrow rest support 320, an archer may then engage the tail section of the arrow 50 with the bowstring of the bow. As the archer begins to draw the bowstring, the second end of the cord 260 that is coupled with the bow's bowstring is pulled, which, in turn, pulls the first end of the cord toward the archer. As the first end of the cord 260 is pulled toward the archer, the cord 260 exerts a force on the arrow rest base 330, which causes the arrow rest base 330 to rotate about its axis of rotation. As the arrow rest base 330 begins to rotate about its axis of rotation, the first arrow support 310 and the second arrow support 320 (being attached adjacent the arrow rest base 330) begin to rotate as well.

As the arrow rest base 330, the first arrow support 310, and the second arrow support 320 begin to rotate about the axis of rotation, the first arrow support 310 and the second arrow support 320 rotate toward the arrow 50. As the first arrow support 310 and the second arrow support 320 continue to rotate toward the arrow 50, the lower portion of the first ramped face 315 and second ramped face 325 begin to engage the shaft of the arrow 50. As the first ramped face 315 and second ramped face 325 begin to engage the shaft of the arrow 50, the first arrow support 310 and second arrow support 320 begin to exert opposing lateral forces on the arrow 50. As the first arrow support 310 and second arrow support 320 continue to rotate toward the arrow, the opposing lateral forces that the first arrow support 310 and second arrow support 320 exert on the arrow 50 facilitate the movement of the arrow 50 up the first ramped face 315 and second ramped face 325.

FIG. 5 shows the first arrow rest support 310 and the second arrow rest support 320 in a slightly rotated position and the arrow 50 at a point that is between the first, resting position and the second, ready-to-fire position. In the position shown in FIG. 5, the arrow 50 is substantially parallel (e.g., parallel) to the ground when the bow is in a substantially vertical orientation. As the first arrow support 310 and second arrow support 320 continue to rotate, the opposing lateral forces continue to drive the arrow 50 up the first and second ramped faces 315, 325 until the arrow 50 engages the first and second angled top portions 314, 324 of the first and second arrow supports 310, 320.

As shown in the embodiment of FIG. 6, as the arrow engages the first and second angled top portions 314, 324, the surface of the arrow shaft substantially mates with (e.g., mates with) the curve of the first and second arrow holding recesses 318, 328. In the embodiment shown in FIG. 6, the first and second arrow holding recesses 318, 328 and the first and second angled top portions 314, 324 are adapted to cooperate to maintain the arrow 50 in the second, ready-to-fire position. In other embodiments, without arrow holding recesses 318, 328, the first and second angled top portions 314, 324 are adapted to cooperate to maintain the arrow 50 in the second, ready-to-fire position.

When the arrow 50 is in the second, ready-to-fire position, the first arrow support 310 and second arrow support 320 exert equal and opposite forces (which may be light forces) on the arrow 50 at equal distances from the axis of rotation of the arrow rest base 330. In this embodiment, the first and second arrow holding recesses 318, 328 hold the arrow substantially parallel (e.g., parallel) to the ground. When the arrow rest 10 is in the second, ready to fire position, the center of a circle formed by the curves of the first and second arrow holding recesses 318, 328 are substantially co-linear with the point on the bowstring that the tail section of the arrow 50 engages when being drawn for firing.

Figure 7:
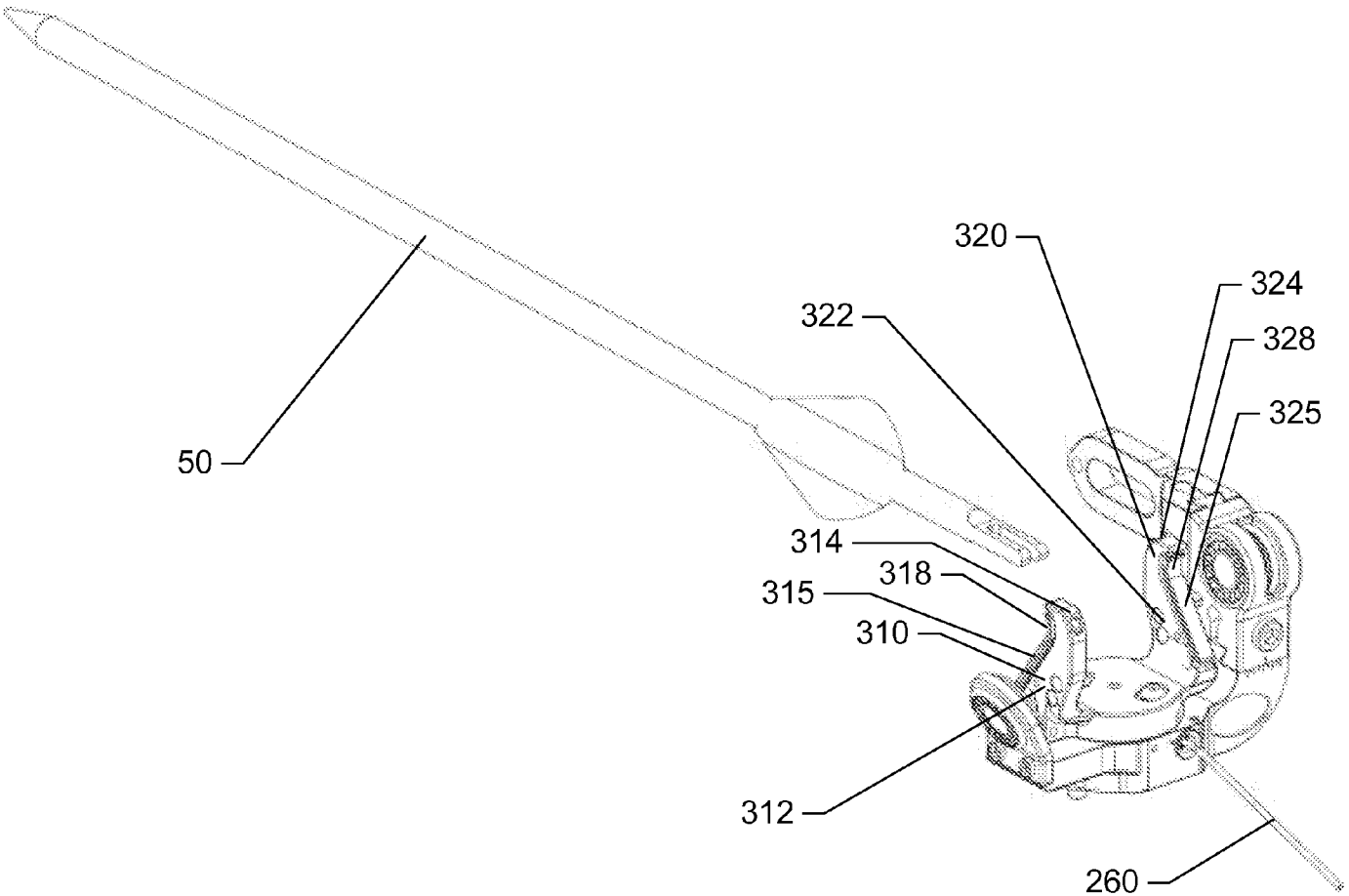
FIG. 7 is a perspective view of the arrow rest of FIG. 1 immediately following the firing of the arrow.
Figure 8:
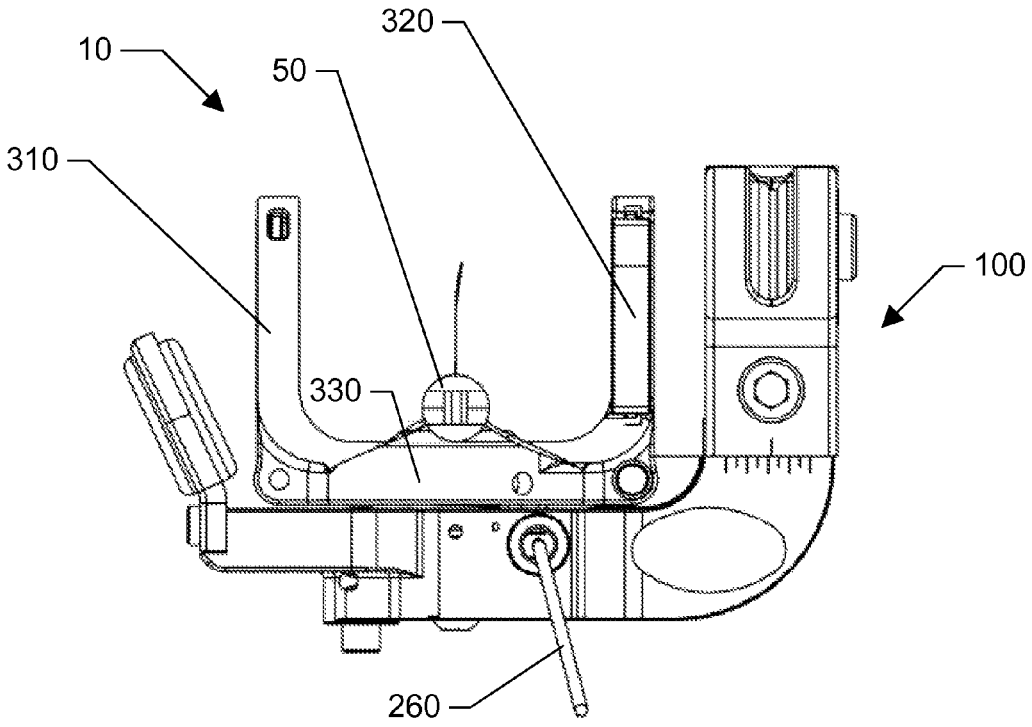
FIGS. 8-11 are rear views of the arrow rest of FIG. 1 as an arrow is moved from a first, resting position to a second, ready-to-fire position.
Figure 9:
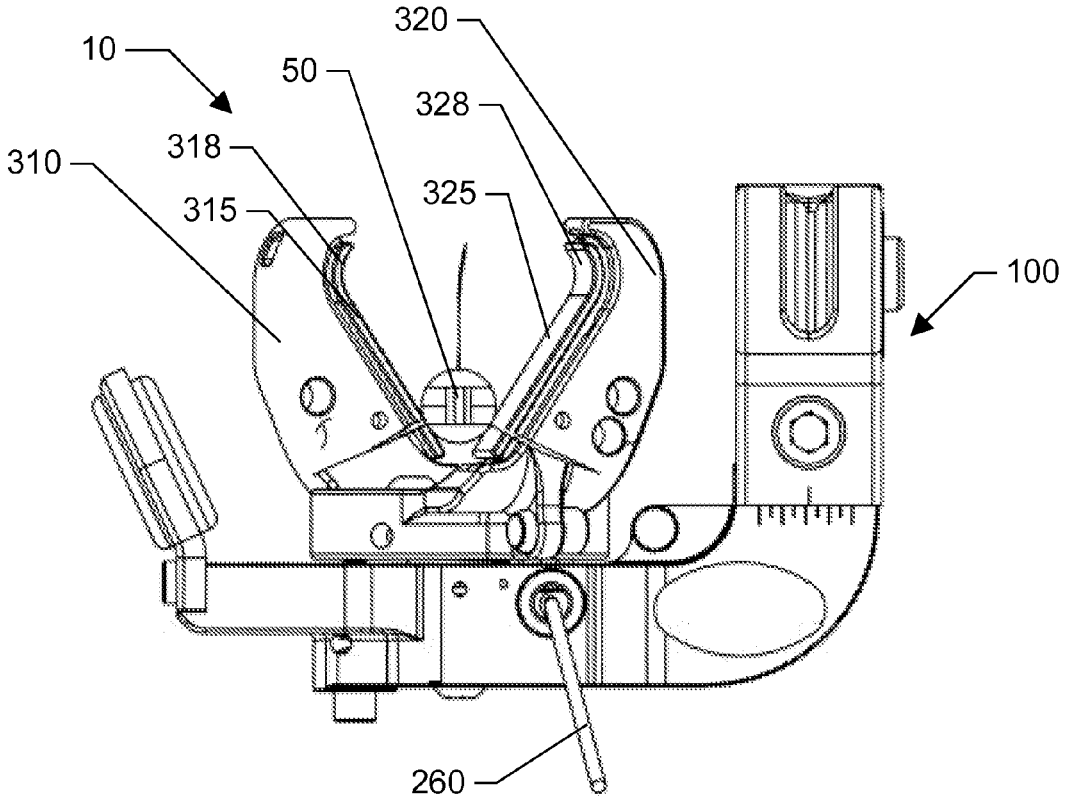
Figure 10:
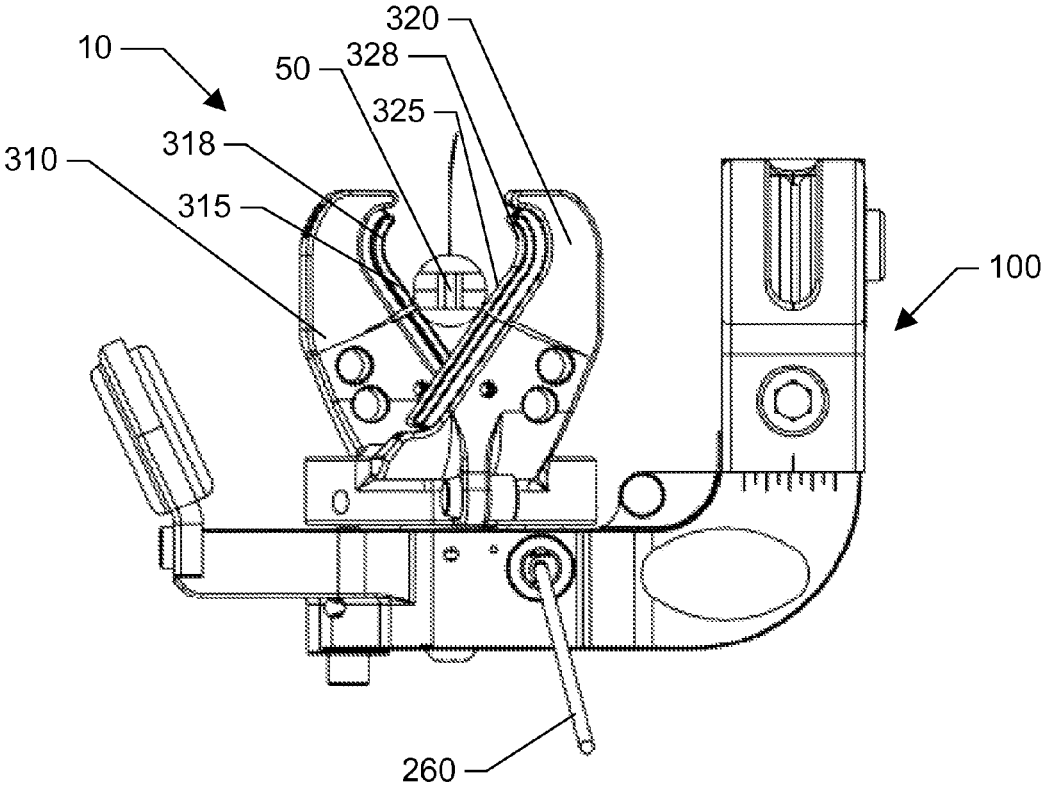
Figure 11:
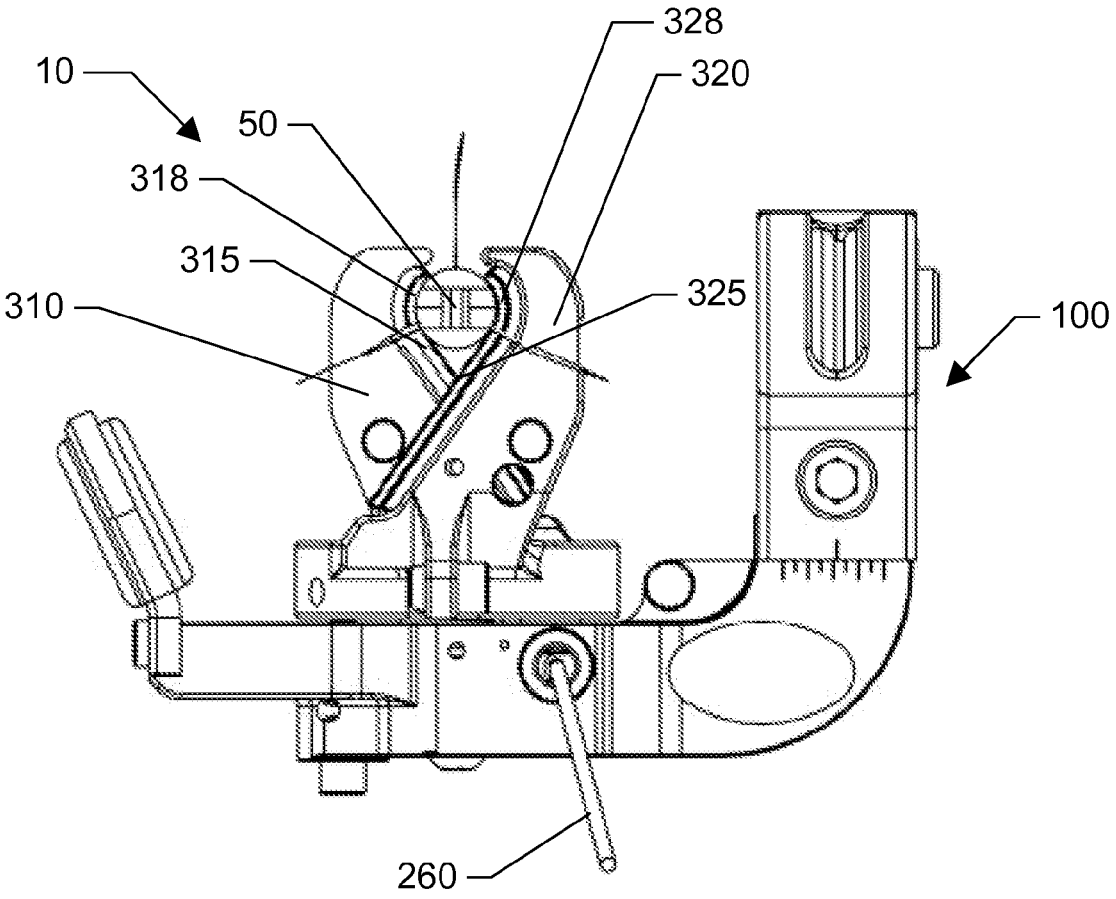

FIG. 7 shows the arrow rest 10 substantially immediately (e.g., immediately) after the archer fires the arrow 50. In the embodiment shown in FIG. 7, the biasing mechanism is adapted to move the arrow rest base 330, the first arrow support 310, and the second arrow support 320, toward the first, resting position substantially immediately after the firing of the arrow 50. In this embodiment, the biasing mechanism is adapted to move the arrow rest base 330, the first arrow support 310, and the second arrow support 320 far enough toward the first, resting position substantially immediately (e.g., immediately) after the firing of the arrow 50 that the first arrow support 310 and the second arrow support 320 do not substantially interfere with the flight of the arrow 50 as the bow launches the arrow 50.

Figure 12:
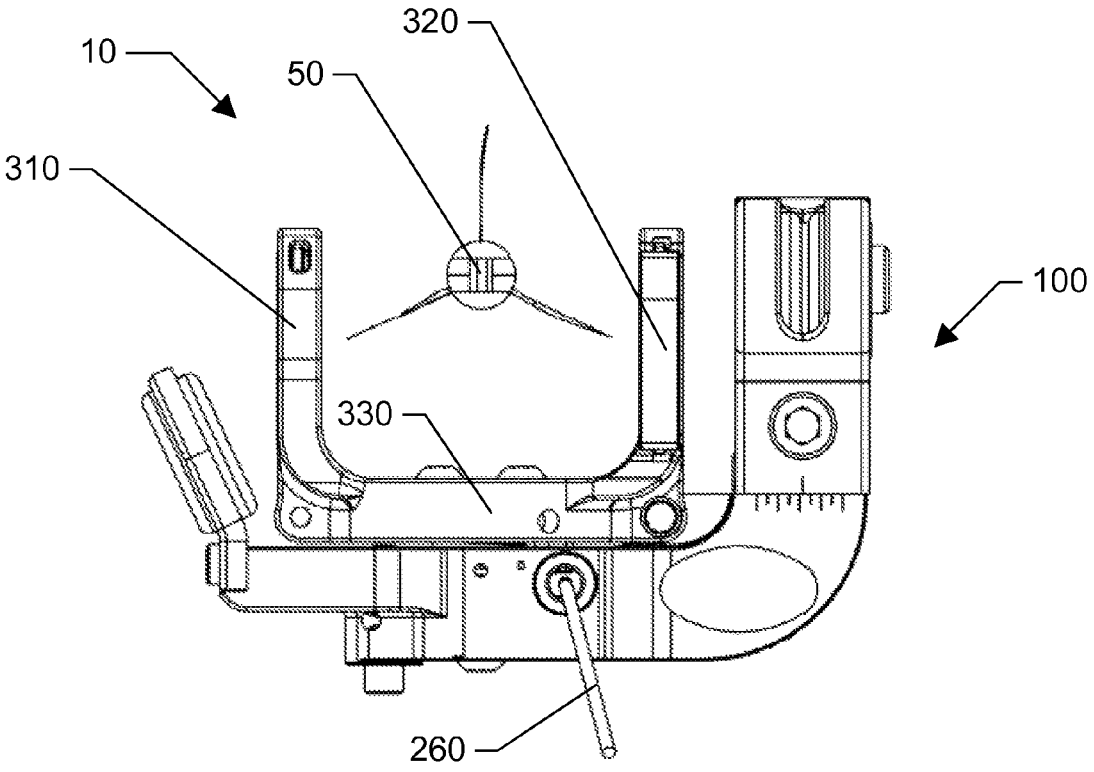
FIG. 12 is a rear view of the arrow rest of FIG. 1 immediately following the firing of the arrow.

FIGS. 8-11 show a rear view of the arrow rest 10 as the arrow 50 as it transitions from a first, resting position to a second, ready-to-fire position. FIG. 12 shows a rear view of the arrow rest 10 substantially immediately (e.g., immediately) after the firing of an arrow.

Alternative Embodiments

Alternative embodiments of the arrow rest 10 may comprise, for example, components that are, in some respects, similar to the various components described above. Selected distinguishing features of various alternative embodiments are discussed below.

Locking Mechanism

In particular embodiments, the arrow rest 10 may comprise a locking mechanism. The locking mechanism may be adapted to lock the arrow rest 10 in the second, ready-to-fire position and may include any suitable locking mechanism (e.g., a pin). In particular embodiments, the locking mechanism may be adapted to release substantially automatically (e.g., automatically) upon the firing of an arrow, or may be adapted to be released manually (e.g., via a push button).

Sliding Arrow Rest Supports

In particular embodiments, the first arrow rest support may comprise an angled leading face and be adapted to slide in a substantially straight (e.g., straight) line towards a fixed second arrow rest support between a first position and a second position. In such embodiments, the angled leading face of the first arrow rest support is adapted to allow an arrow to slide up the angled leading face as the first arrow rest support slides adjacent to the second arrow rest support. In particular embodiments, the first and second arrow rest supports may be adapted cooperate to move an arrow from a first, resting position to a second, ready-to-fire position. In other embodiments of a sliding arrow rest support, the second arrow rest support may also include an angled leading face and be adapted to slide towards the first arrow rest support.

Felt Covered First and Second Ramped Face

In particular embodiments, the first ramped face 310 and second ramped face 320 may be covered by a layer of felt or similar material. In various embodiments, the felt may be adapted to decrease the sound of an arrow sliding up the first and second ramped faces 310, 320. Such embodiments may be useful in hunting applications when making noise can alert potential prey.

Spring Loaded First and Second Ramped Faces

In particular embodiments, the first ramped face 315 and second ramped face 325 may be adapted to be substantially non-rigid (e.g., non-rigid). In particular embodiments, the substantial non-rigidity (e.g., non-rigidity) may be achieved by placing springs behind the first ramped face 315 and second ramped face 325.

Conclusion

Many modifications and other embodiments of the invention will come to mind to one skilled in the art to which this invention pertains having the benefits of the teachings presented in the foregoing descriptions and the associated drawings. For example, as will be understood by one skilled in the relevant field in life of this disclosure, the invention may take form in a variety of different mechanical and operational configurations. Therefore, it is to be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

We claim:

1. An arrow rest for a bow comprising:
- an arrow rest mount;
- an arrow rest base disposed adjacent said arrow rest mount;
- a first arrow support disposed adjacent a top surface of said arrow rest base, wherein said first arrow support defines:
  - a first base portion extending upward from a base of said first arrow support wherein said first base portion defines a first ramped face that extends upwardly and rearwardly along a leading edge of said first base portion;
  - a first angled top portion extending upwardly and forward from an upper end of said first base portion; and
- a second arrow support disposed adjacent a top surface of said arrow rest base, wherein said second arrow support defines:
  - a second base portion extending upwardly from a base of said second arrow support wherein said second base portion defines a second ramped face that extends upward and rearward along the leading edge of said second base portion;
  - a second angled top portion extending upward and forward from an upper end of said second base portion; wherein:
    - said arrow rest base, said first arrow support, and said second arrow support are disposed about an axis of rotation;
    - said first arrow support and said second arrow support are adapted to rotate about said axis of rotation to exert opposing lateral forces on an arrow at substantially the same time; and
    - said opposing lateral forces facilitate the movement of said arrow up said first ramped face and said second ramped face.

2. The arrow rest of claim 1, wherein:
- said axis of rotation is substantially centered within said arrow rest base;
- said first arrow support is disposed a first distance from said axis of rotation; and
- said second arrow support is disposed a second distance from said axis of rotation.

3. The arrow rest of claim 2, wherein said first distance is substantially the same as said second distance.

4. The arrow rest of claim 1, wherein said arrow rest base comprises a biasing mechanism wherein said biasing mechanism is adapted to bias said arrow rest base toward a particular home position.

5. The arrow rest of claim 4, wherein said particular home position is a first, resting position.

6. The arrow rest of claim 5, wherein said arrow rest base is adapted to rotate between said first, resting position and a second, ready-to-fire position.

7. The arrow rest of claim 6, wherein said arrow rest base rotates about ninety degrees about said axis of rotation between said first, resting position and said second, ready-to-fire position.

8. The arrow rest of claim 7, wherein:

said first arrow support is adapted to rotate toward said arrow as said arrow rest base rotates from said first, resting position to said second, ready-to-fire position;

said second arrow support is adapted to rotate toward said arrow as said arrow rest base rotates from said first, resting position to said second ready-to-fire position;

said first ramped face is adapted to substantially engage said arrow as said first ramped face contacts said arrow as said first arrow support rotates toward said arrow;

said second ramped face is adapted to substantially engage said arrow as said second ramped face contacts said arrow as said second arrow support rotates toward said arrow; and said first arrow support and said second arrow support are adapted to exert said opposing lateral forces on said arrow as said first ramped face substantially engages with said arrow and said second ramped face substantially engages with said arrow.

9. The arrow rest of claim 8, wherein said opposing lateral forces facilitate the movement of said arrow up said first ramped face and said second ramped face until said arrow substantially engages said first angled top portion and said second angled top portion.

10. The arrow rest of claim 9, wherein said first angled top portion and said second angled top portion are adapted to cooperate to maintain said arrow in said second, ready-to-fire position.

11. The arrow rest of claim 10, wherein:

the upper portion of said first ramped face defines a first arrow holding recess;

the upper portion of said second ramped face defines a second arrow holding recess;

one or more curved surfaces defined by said first and second arrow holding recesses have a radius that substantially corresponds to a radius of a shaft of a standard arrow; and said first arrow holding recess and said second arrow holding recess are adapted to cooperate with said first angled top portion and said second angled top portion to maintain said arrow in said second, ready-to-fire position.

12. The arrow rest of claim 11, wherein:

a center of one or more of said curved surface of said first or second arrow holding recess is substantially co-linear with a point on a bowstring of said bow that a tail portion of said arrow engages when said arrow is drawn for firing, and said arrow rest is in said second, ready-to-fire position; and said arrow is substantially parallel to the ground when said arrow rest is in said second, ready-to-fire position and said bow is in a substantially vertical orientation.

13. The arrow rest of claim 12, wherein:

said first ramped face is substantially flat; and said second ramped face is substantially flat.

14. The arrow rest of claim 13, wherein:

said first ramped face is sufficiently smooth to allow said shaft of said arrow to slide up said first ramped face; and said second ramped face is sufficiently smooth to allow said shaft of said arrow to slide up said second ramped face.

15. The arrow rest of claim 11, wherein said arrow rest comprises a biasing mechanism that is adapted to move said arrow rest base a sufficient amount toward said first, resting position substantially immediately following the firing of said arrow such that said first arrow support and said second arrow support do not substantially interfere with the flight of said arrow.

16. The arrow rest of claim 1, wherein:

said first arrow support is substantially parallel to said second arrow support; and said first arrow support and said second arrow support are disposed facing substantially opposite directions.

17. The arrow rest of claim 1, further comprising a cord, wherein:

said cord is adapted to rotate said first arrow rest support and said second arrow rest support when said cord is pulled; and said cord is coupled with said bowstring of said bow and adapted to be pulled when said bowstring is drawn to fire said arrow.

18. The arrow rest of claim 17, wherein:

said arrow rest comprises a locking mechanism; and said locking mechanism is adapted to lock said arrow in said ready-to-fire position.

* * * * *